US012188300B2

(12) United States Patent
Ricks et al.

(10) Patent No.: US 12,188,300 B2
(45) Date of Patent: Jan. 7, 2025

(54) PROTECTED BACK-UP RINGS FOR METAL FACE SEALS AND EARTH BORING TOOLS INCORPORATING THE SAME

(71) Applicant: Baker Hughes Oilfield Operations LLC, Houston, TX (US)

(72) Inventors: Gregory L. Ricks, Spring, TX (US); Jon David Schroder, The Woodlands, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/189,900

(22) Filed: Mar. 24, 2023

(65) Prior Publication Data

US 2024/0318506 A1 Sep. 26, 2024

(51) Int. Cl.
*E21B 10/25* (2006.01)

(52) U.S. Cl.
CPC ..... *E21B 10/25* (2013.01)

(58) Field of Classification Search
CPC ..... E21B 10/25
See application file for complete search history.

(56) References Cited

U.S. PATENT DOCUMENTS 4,428,687 A * 1/1984 Zahradnik ..... E21B 10/25 175/371
6,026,917 A * 2/2000 Zahradnik ..... E21B 10/25 175/371
7,117,961 B2 10/2006 Yong et al.
7,234,541 B2 6/2007 Scott et al.
7,413,037 B2 8/2008 Lin et al.
8,967,301 B2 * 3/2015 Curry ..... E21B 10/25 175/371
9,157,280 B2 10/2015 Lin et al.
(Continued)

FOREIGN PATENT DOCUMENTS

CN 200982159 Y 11/2007
CN 201771428 3/2011
(Continued)

OTHER PUBLICATIONS

International Search Report for Application No. PCT/US2024/021154 dated Jul. 22, 2024, 3 pages.
(Continued)

*Primary Examiner* — Blake Michener
(74) *Attorney, Agent, or Firm* — TraskBritt

(57) ABSTRACT

An earth-boring rotary drill tool may comprise a body comprising a pin, a roller cone mounted on the pin, and a seal assembly disposed between the pin and the roller cone. The first ring may comprise longitudinally converging sidewall surfaces defining a minimum radial thickness of the first ring at points of tangential intersection with a convex curved surface spanning a radial thickness of the first ring. The second ring may comprise a concave surface located and configured to interface over an area of contact with the convex curved surface of the first ring. The third ring may be positioned adjacent to, and concentric with, the second ring. The second ring may be disposed radially inward from the third ring. The first ring may also contact a surface of the roller cone or an insert ring adjacent the roller cone to form a seal between the first ring and the surface.

20 Claims, 13 Drawing Sheets

(56) References Cited

U.S. PATENT DOCUMENTS

| | | | | |
|---|---|---|---|---|
| 9,249,629 | B2 | 2/2016 | Lin et al. | |
| 9,316,055 | B2 | 4/2016 | Lin et al. | |
| 11,131,148 | B2 | 9/2021 | Ricks | |
| 2003/0075363 | A1* | 4/2003 | Lin | E21B 10/25 175/57 |
| 2004/0000435 | A1* | 1/2004 | Nguyen | E21B 10/25 175/372 |
| 2005/0211474 | A1* | 9/2005 | Nguyen | E21B 10/08 175/371 |
| 2006/0032673 | A1* | 2/2006 | Yong | E21B 10/25 175/371 |
| 2006/0060359 | A1* | 3/2006 | Lin | E21B 10/25 166/371 |
| 2006/0231292 | A1* | 10/2006 | Lin | F16C 33/72 175/371 |
| 2007/0045008 | A1* | 3/2007 | Dick | E21B 10/22 175/371 |
| 2009/0194339 | A1 | 8/2009 | Dick et al. | |
| 2014/0225327 | A1* | 8/2014 | Lin | E21B 10/25 277/390 |
| 2014/0225328 | A1* | 8/2014 | Lin | E21B 10/25 277/390 |
| 2020/0408044 | A1* | 12/2020 | Ricks | F16J 15/3496 |

FOREIGN PATENT DOCUMENTS

| | | | |
|---|---|---|---|
| CN | 104763341 | A | 7/2015 |
| CN | 105051311 | A | 11/2015 |

OTHER PUBLICATIONS

International Written Opinion for Application No. PCT/US2024/021154 dated Jul. 22, 2024, 5 pages.

* cited by examiner

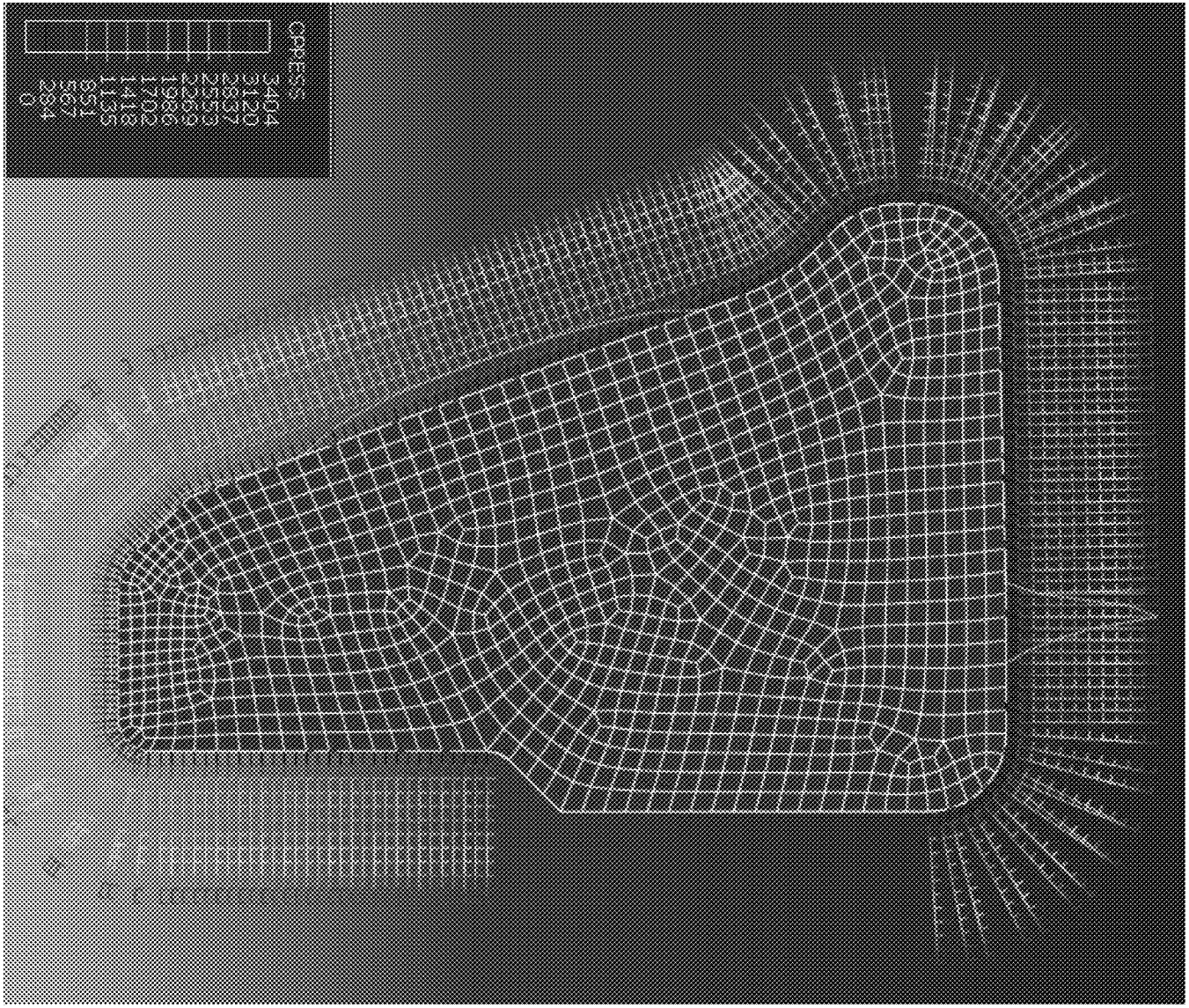
CPRESS
1454
1212
1969
1727
1485
1243
1002
760
518
277
35
-207
-449
-691
-933
-1175
-1417
-1659
-1901
-2143
-2384
-2626
-2868
-3110
-3352
-3594
-3836
-4078
-4320
-4562
-4804
-5046
-5288
-5530
-5772
-6014
-6256
-6498
-6740
-6982
-7224
-7466
-7708
-7950
-8192
-8434
-8676
-8918
-9160
-9402
-9644
-9886
-10128
-10370
-10612
-10854
-11096
-11338
-11580
-11822

PROTECTED BACK-UP RINGS FOR METAL FACE SEALS AND EARTH BORING TOOLS INCORPORATING THE SAME

TECHNICAL FIELD

Embodiments of the present disclosure generally relate to devices and methods involving rotatable elements for earth-boring tools used in earth boring operations and, more specifically, to protected back-up rings for a metal face seal in a seal assembly for earth-boring rotary tools, and to related methods.

BACKGROUND

Rotary drill bits, such as roller cone bits, are commonly used in forming bore holes or wells in earth formations. A conventional roller cone earth boring bit has three cones rotatably mounted to bearing pins carried by circumferentially spaced (e.g., 120°) legs extending from the bit body. A seal assembly contains lubricant within a cavity of the cone surrounding the bearing pin.

In particular, the seal assembly includes a metal seal ring that is biased against an internal surface of a roller cone to form a metal face seal. A first polymer ring (also referred to as an energizer), when compressed, provides the primary force which biases the metal seal ring against the internal surface of the roller cone (or primary face load on the metal face seal). A second polymer ring, when compressed, provides a lesser secondary force (or lesser face load, such as 20-40% of the total face load), as compared to the primary force generated by the first polymer ring. In other words, the second polymer ring "backs up" the first polymer ring with respect to providing a face load to the metal face seal. Accordingly, the second polymer ring is also referred to as a back-up ring (BUR).

The primary function of the secondary polymer ring is stopping ingress of matter in the surrounding drilling environment (e.g., drilling mud, formation debris, etc.) into a cavity between the metal face seal components and the base area of the bearing pin. Typically, the material of the secondary polymer ring has a low Shore A hardness to meet various design requirements of the seal assembly. As a result, the second polymer ring is susceptible to damage (e.g., tearing), allowing contaminants into the cavity, reducing effectiveness of the lubricant and impairing free rotation of the cone, wearing bearings in the cone assembly and reducing the reliability and life of the rotary drill bit, as a whole.

The service life of the secondary polymer ring (e.g., the BUR) may be extended by introducing an additional concentric ring (e.g., an excluder) to protect the secondary polymer ring from damage caused by contact with matter in the surrounding drilling environment.

BRIEF SUMMARY

The present disclosure describes an earth-boring tool that includes a rotary drill with a body comprising at least one pin, at least one roller cone mounted on the at least one pin and configured to rotate about the at least one pin during use of the earth-boring rotary drill, and at least one seal assembly disposed between the at least one pin and the at least one roller cone. The at least one seal assembly includes a plurality of rings configured to remain stationary with respect to rotation of the at least one roller cone. The plurality of rings includes a seal ring, which comprises a distal surface proximate a surface of an insert ring positioned between the at least one roller cone and the at least one pin, and a proximal surface proximate the base of the at least one pin. The distal surface forms a seal with the surface of the insert ring. In other embodiments, a distal surface of the seal ring is proximate a surface of the at least one roller cone, and the distal surface of the seal ring forms a seal with the surface of the roller cone. The seal ring comprises a metal material.

The at least one seal assembly further includes a first polymer ring (i.e., an energizer ring) disposed radially inward the seal ring. The first polymer ring is located and configured to be at least partially compressed by the seal ring when the seal assembly is in an assembled state. While at least partially compressed, the first polymer ring applies a first force on the seal ring that biases the distal surface of the seal ring towards the surface of the at least one roller cone. The at least one seal assembly further includes a second polymer ring adjacent the proximal surface of the seal ring. The second polymer ring is located and configured to be at least partially compressed by the seal ring when the seal assembly is in an assembled state. While at least partially compressed, the second polymer ring applies a second force on the seal ring that biases the distal surface of the seal ring towards the surface of the at least one roller cone. The at least one seal assembly further includes an additional ring adjacent to, concentric with, and radially outward from the second polymer ring. The additional ring is located and configured to at least substantially prevent damaging contact between debris from the drilling environment and the second polymer ring.

The present disclosure further describes a method for assembling a seal assembly. The method includes positioning a first ring (i.e., a back-up ring) adjacent a base of the at least one pin such that the first ring contacts an area of the pin, positioning a second ring (i.e., a seal ring) adjacent a base of the at least one pin, positioning a third ring (i.e., an excluder ring) adjacent to, and radially outward from, the first ring, wherein the third ring is concentric with the first ring. The method further comprises translating the at least one roller cone towards a base of the at least one pin. The translation of the at least one roller cone causes the second ring to translate in the same direction, to cause the second ring to contact, and at least partially compress, the first ring.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

While the specification concludes with claims particularly pointing out and distinctly claiming embodiments of the present disclosure, the advantages of embodiments of the disclosure may be more readily ascertained from the following description of embodiments of the disclosure when read in conjunction with the accompanying drawings in which:

FIG. 16 is a diagram of the results of a FEA of the contact stresses of a seal ring of a previous design.

DETAILED DESCRIPTION

The illustrations presented herein are not meant to be actual views of any particular earth-boring rotary drill bit, rotatable cutting element, or component thereof, but are merely idealized representations employed to describe illustrative embodiments. The drawings are not necessarily to scale.

The embodiments disclosed relate generally to seals and seal assemblies for earth-boring rotary drill bits. More specifically, the embodiments disclosed relate to seal assemblies for earth-boring rotary drill bits which include rotatable cones or other rotatable elements that may rotate responsive to rotation of the drill bit when engaging formation material in order to alter the positioning of the rotatable elements relative to an earth-boring tool to which the rotatable elements are coupled. For example, such a configuration may enable structures (e.g., teeth, inserts) carried on the exterior and protruding from the rotatable elements to crush and gouge a rock formation due to the rolling motion of the rotatable element under applied weight on bit (WOB). Embodiments of the disclosure include a seal or seal assembly. The seal or seal assembly may be configured to seal a lubricant in a cavity between a rotatable element (e.g., roller cone) and bearing pin upon which the rotatable element is mounted. Such seals or seal assemblies may also be utilized to prevent debris from entering the cavity between the roller cone and the bearing pin.

As used herein, the term "roller cone" means and includes an element (i.e., structure) rotatably mounted to an earth-boring tool and configured with protrusions (e.g., integral teeth, inserts carried in pockets on an exterior of the element) to gouge, crush and abrade material of a subterranean formation. The term roller "cone" is a term of art and non-limiting with respect to the actual physical shape of the element, which may be conical, cylindrical, elliptical, etc.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

Figure 1:
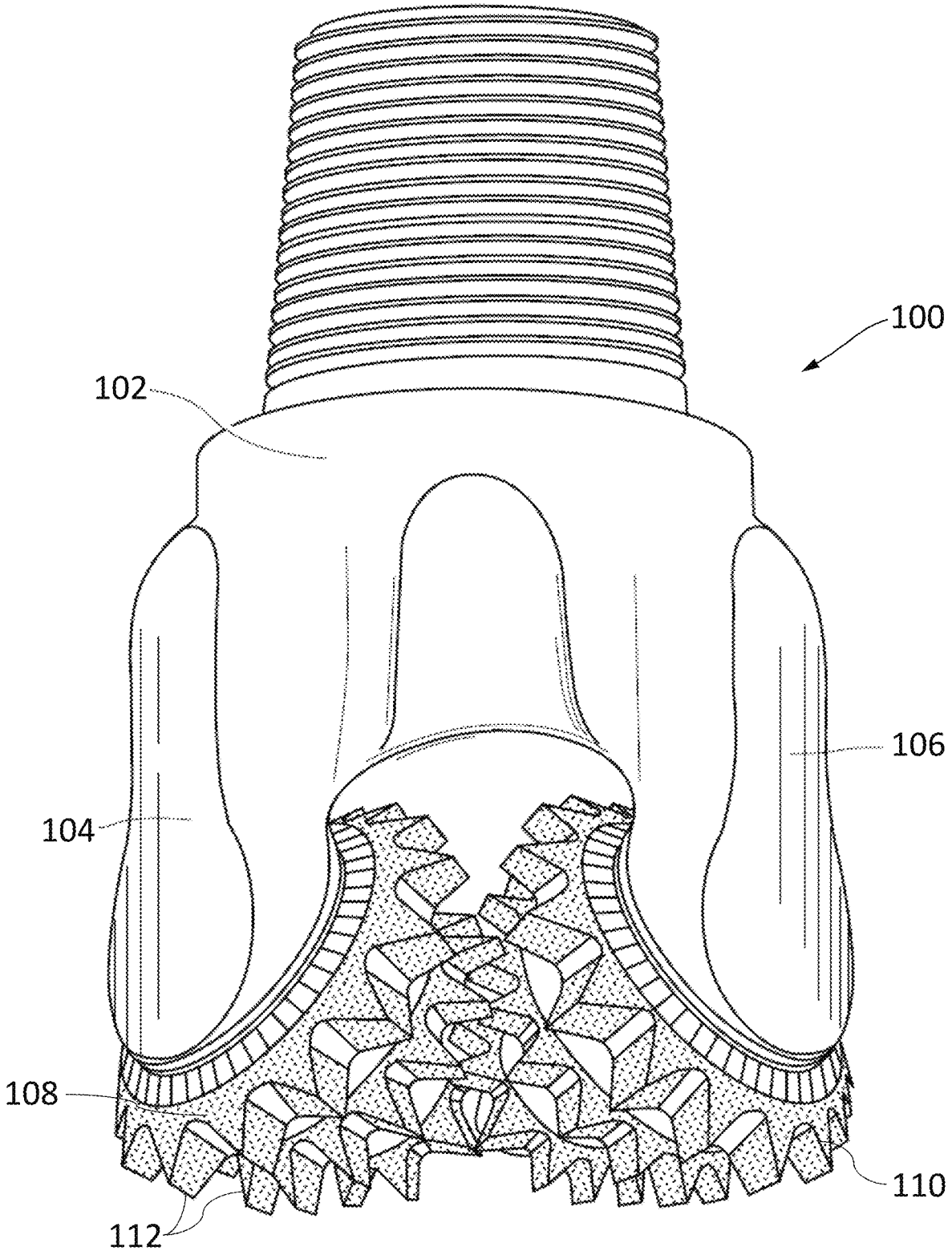
FIG. 1 is an isometric view of an earth-boring rotary drill bit.

FIG. 1 illustrates an example of an earth-boring rotary drill bit which may be used in conjunction with an earth-boring downhole drill string. More specifically, FIG. 1 illustrates a rotary drill bit 100 (e.g., a roller cone drill bit) with a body 102, legs (e.g., leg 104 and leg 106), and rotatable elements (e.g., roller cone 108 and roller cone 110). A third leg and roller cone carried thereby is not shown. In some embodiments, rotary drill bit 100 may comprise several legs, e.g., three or four legs, and may further comprise a corresponding number of roller cones, e.g., three or four roller cones. Teeth 112 are formed (e.g., machined) on exterior surfaces of roller cones 108 and 110.

Figure 2:
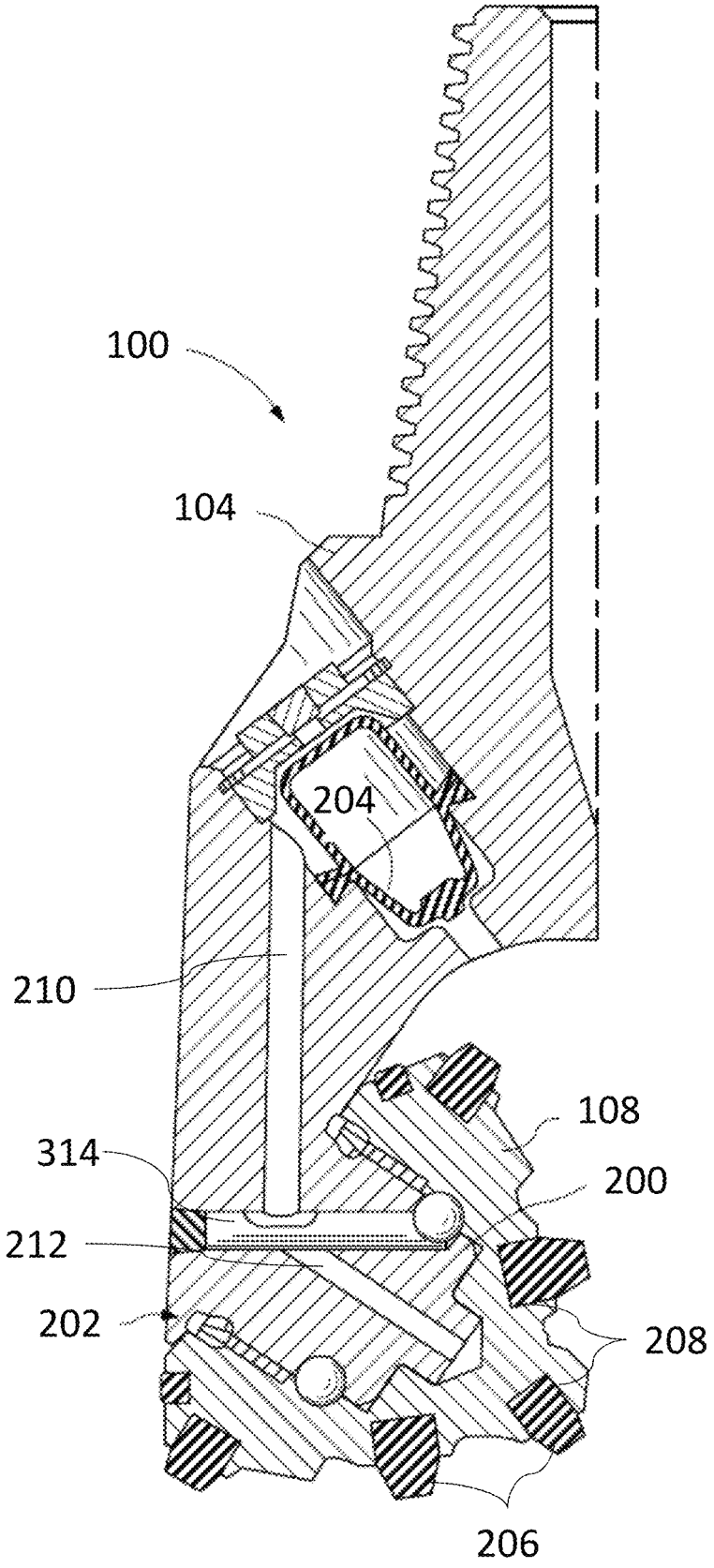
FIG. 2 is a longitudinal cross-sectional view of a portion of an earth-boring rotary drill bit of FIG. 1.

FIG. 2 illustrates a partial, longitudinal cross-sectional view of a portion of another earth-boring rotary drill bit. Each leg of the rotary drill bit, such as leg 104, has a depending pin, such as bearing pin 200. A rotatable element, such as roller cone 108, is disposed on leg 104, and is rotatably mounted on bearing pin 200 at the distal end of leg 104. A seal assembly, such as seal assembly 202, may be positioned in a space between bearing pin 200 and roller cone 108. In the drill bit of FIG. 2, roller cones (e.g., roller cone 108) carries inserts 206 retained in pockets 208 formed in the exterior thereof.

The following disclosure will generally make reference to leg 104, roller cone 108, and seal assembly 202. However, it should be understood that each leg and corresponding roller cone may be similar in structure and have a separate seal assembly. Accordingly, the disclosure herein may equally apply to any leg, roller member, or seal assembly of the rotary drilling tool.

Figure 3:
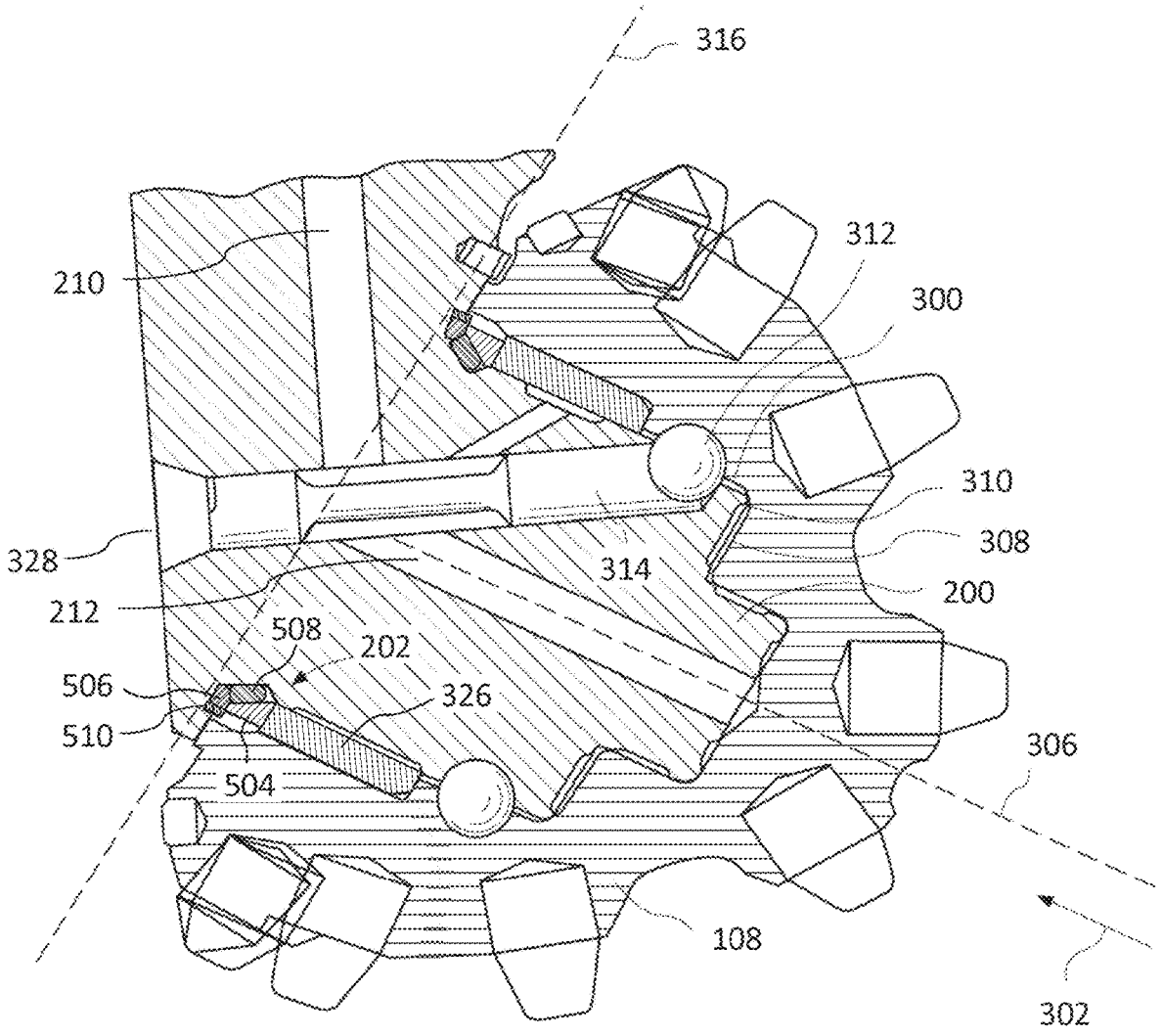
FIG. 3 is an enlarged longitudinal cross-sectional view of a portion of the earth-boring rotary drill bit of FIG. 1.
Figure 4:
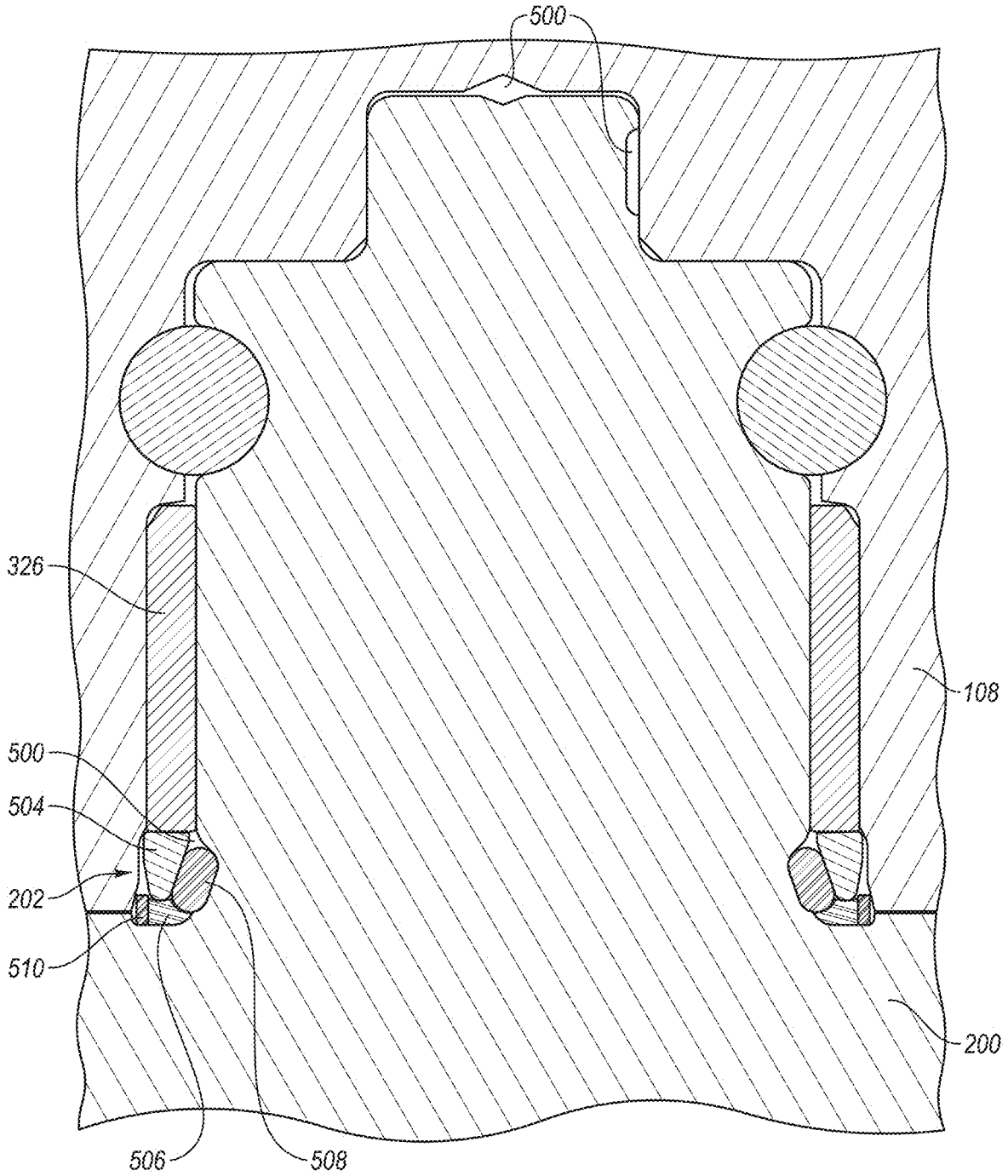
FIG. 4 is a simplified cross-sectional view of a portion of the portion illustrated in FIG. 3.

FIG. 3 illustrates an enlarged cross-sectional view of roller cone 108 mounted on bearing pin 200 with seal assembly 202 positioned in the space between roller cone 108 and bearing pin 200. Roller cone 108 comprises internal cavity 300, which is defined by the internal surfaces of roller cone 108. Bearing pin 200 extends into internal cavity 300 when roller cone 108 is mounted on bearing pin 200. FIG. 4 is a simplified cross-sectional view of the same.

Roller cone 108 is mounted on bearing pin 200 by translating (i.e., pressing) roller cone 108 in a first axial direction 302 towards the base of bearing pin 200 (i.e., where bearing pin 200 meets leg 104). Roller cone 108 is translated in the first axial direction 302 until an interior surface of roller cone 108, such as surface 308, seats against a surface of bearing pin 200, such as planar surface 310. In the assembled state, roller cone 108 is retained on bearing pin 200 by a plurality of ball bearings 312. Ball bearings 312 are inserted into a raceway between roller cone 108 and bearing pin 200 through a passageway 328, which is then plugged with a ball plug 314, to retain the ball bearings 312 in the raceway between roller cone 108 and bearing pin 200. Ball bearings 312 allows roller cone 108 to rotate about bearing pin 200. As such, roller cone 108 is rotatably mounted to bearing pin 200, and is capable of rotating about axis 306. In the disclosed embodiment, insert ring 326 is also positioned between roller cone 108 and bearing pin 200. In some embodiments, insert ring 326 may be shorter and roller bearings may be added distally on bearing pin 200 to aid in the rotation of roller cone 108 about bearing pin 200.

When roller cone 108 is mounted on bearing pin 200, a space remains between roller cone 108 and bearing pin 200, namely, cavity 500. Cavity 500 comprises the space between the inner surfaces of roller cone 108 and the exterior surfaces of bearing pin 200. During use, cavity 500, is filled with lubricant to reduce friction and wear between roller cone 108 and bearing pin 200. Rotary drill bit 100 comprises compensator 204 (see FIG. 2), which is in communication with lubricant in channel 210 in leg 104 extending past ball plug 314 to channel 212 in bearing pin 200 to cavity 500. Compensator 204 pressurizes the lubricant when rotary drill bit 100 is located in a borehole such that the pressure of the lubricant is at least substantially equal to the hydrostatic pressure within the drilling environment (i.e., the annulus between the drill string and the wall of the borehole). Each leg, pin, and roller cone assembly may utilize a separate compensator.

Figure 5:
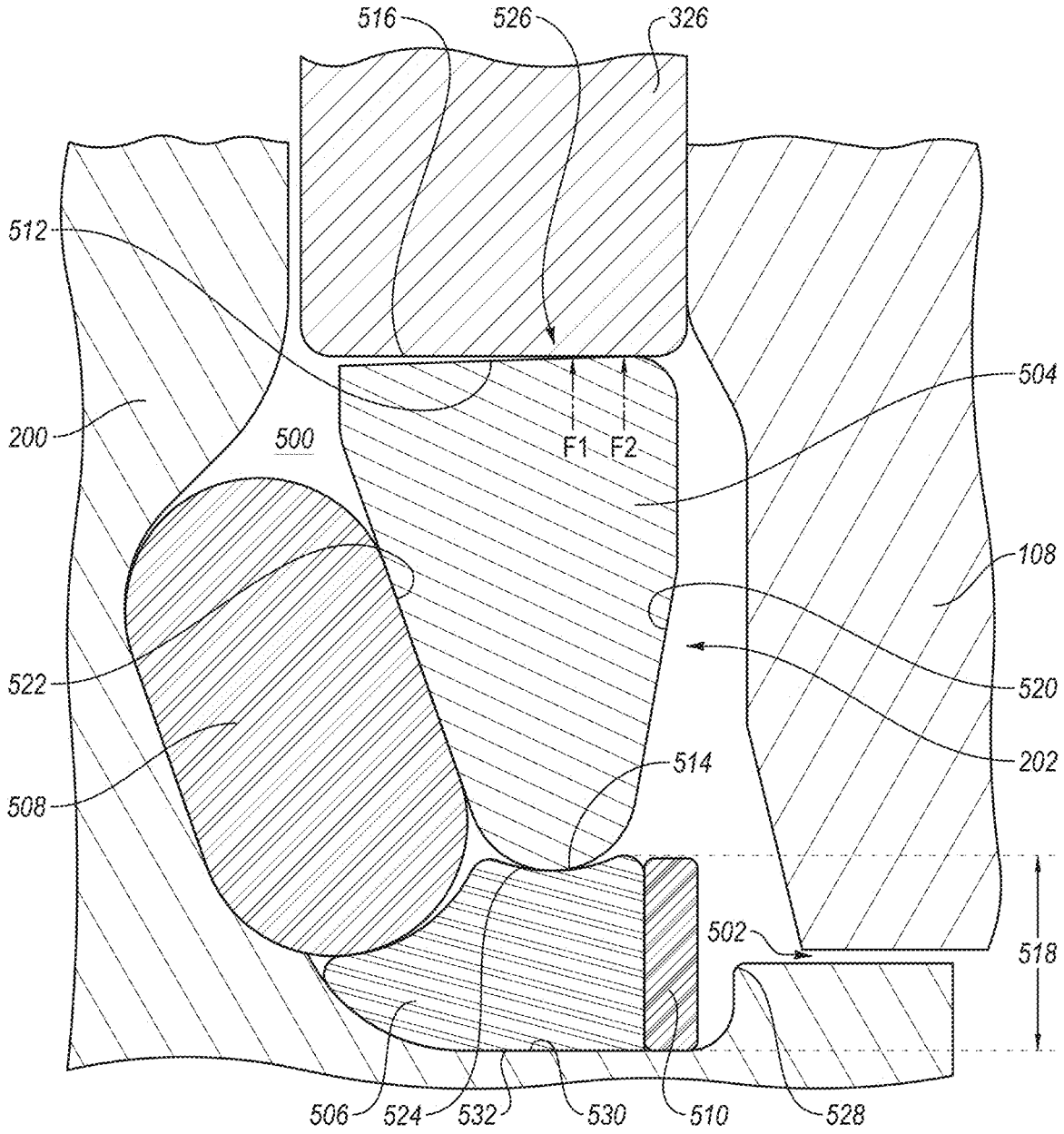
FIG. 5 is a cross-sectional view of a seal assembly.

When roller cone 108 is translated in the first axial direction 302, a surface of insert ring 326 and a surface of seal assembly 202 come together to form a metal face seal, such as metal face seal 526, as best shown in FIGS. 4 and 5. The metal face seal (i.e., the contact between a surface of seal assembly 202 and a surface of insert ring 326), contains the lubricant within cavity 500, and at least substantially prevents drilling debris within the drilling environment in a downhole formation (e.g., drilling fluid, mud, cuttings, etc.) from penetrating into cavity 500. Without seal assembly 202, cavity 500 would be open to the drilling environment via a gap between roller cone 108 and bearing pin 200, such as gap 502. Therefore, without seal assembly 202, the lubricant would not be contained, and debris from the drilling environment could cause excessive friction and wear on bearing pin 200 and/or roller cone 108 as roller cone 108 rotates about bearing pin 200 when rotary drill bit 100 is in use.

FIG. 5 is an enlarged cross-sectional view of seal assembly 202 in an assembled state (i.e., when roller cone 108 is mounted on bearing pin 200). In particular, FIG. 5 shows the cross-sectional shapes of the individual components which comprise seal assembly 202, along with each component's physical position within seal assembly 202. Seal assembly 202 comprises a plurality of rings: seal ring 504, BUR 506, energizer 508, and excluder 510. Each of seal ring 504, BUR 506, energizer 508, and excluder 510 are rings which encircle bearing pin 200, and are coaxial with axis 306.

Figure 6:
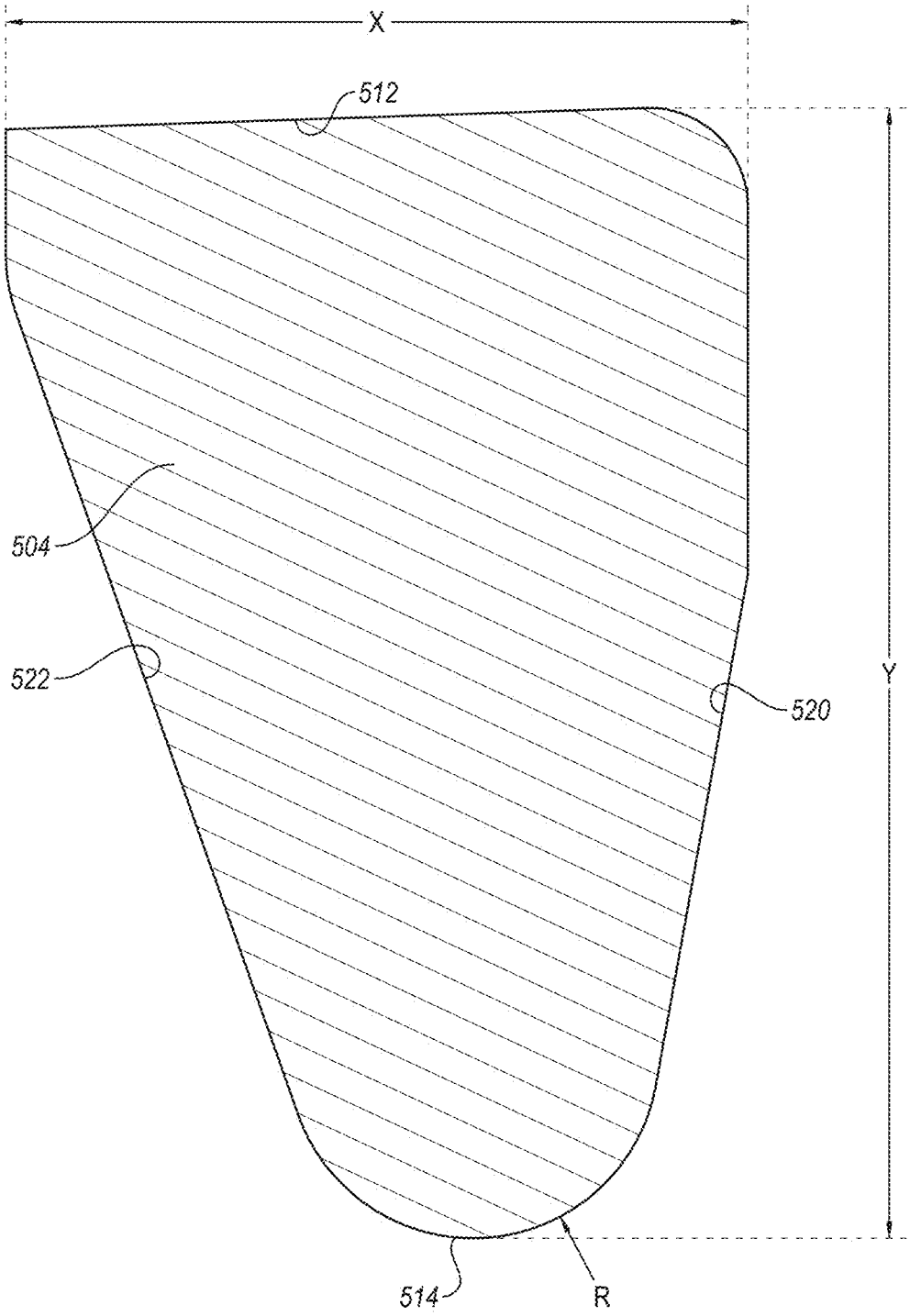
FIG. 6 is an isolated cross-sectional view of a seal ring of a seal assembly.
Figure 11:
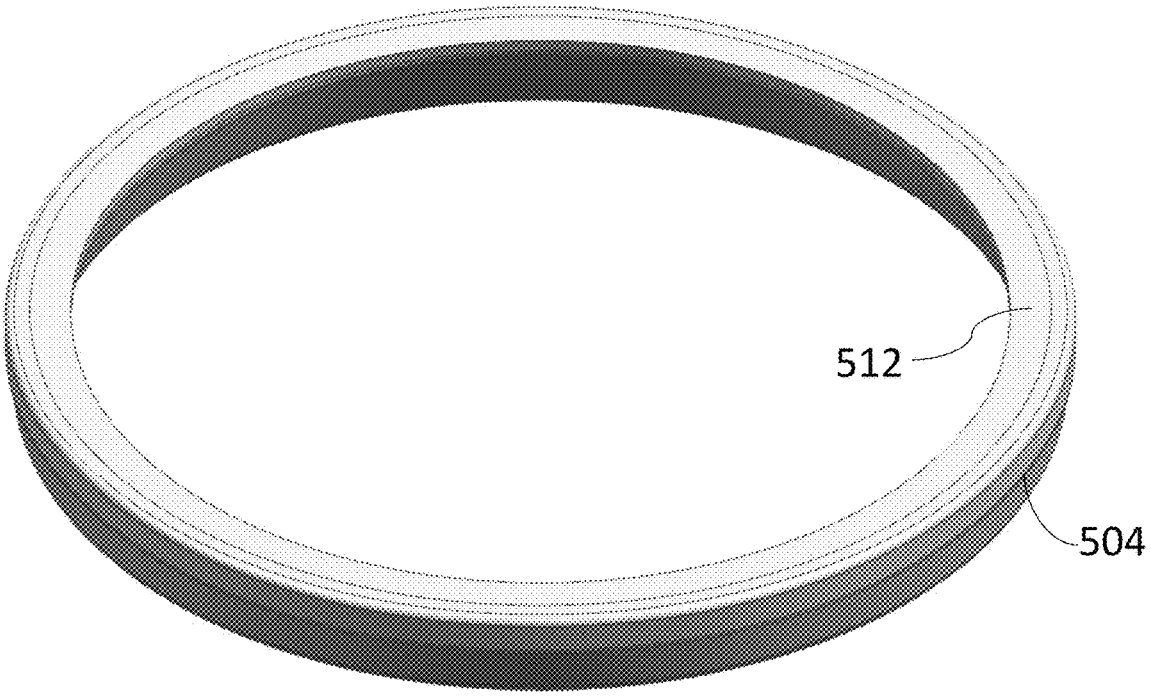
FIG. 11 is an isolated isometric view of the seal ring of FIG. 6.
Figure 12:
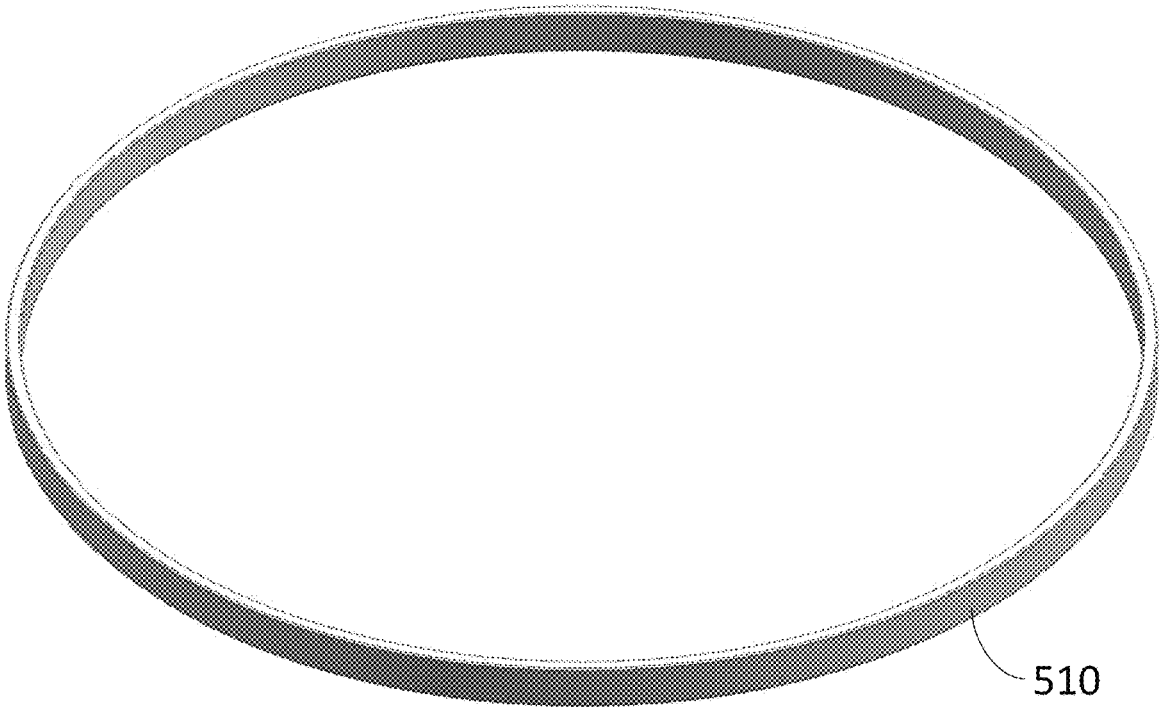
FIG. 12 is an isolated isometric view of the excluder of FIG. 10.

With reference to FIGS. 5, 6, and 11, seal ring 504 comprises a distal surface 512 and a proximal surface 514. As used herein, the terms "distal" and "proximal" are relative to the base of bearing pin 200, which is illustrated in FIG. 3 by plane 316, which extends through the base of the pin perpendicular to the axis 306. In other words, distal surface 512 is distal with respect to plane 316, and proximal surface is proximal with respect to plane 316. Distal surface 512 of seal ring 504 abuts a surface of insert ring 326, such as surface 516, to form metal face seal 526. Metal face metal face seal 526 is a dynamic seal, meaning that seal ring 504 is configured to remain stationary with respect to bearing pin 200 as roller cone 108 and insert ring 326 rotate about bearing pin 200 when rotary drill bit 100 is in operation. In some embodiments, insert ring 326 may be omitted, and surface 516 may be a surface on an inner surface of roller cone 108. As described above, insert ring 326 may back roller bearings on bearing pin 200 to further aid in the rotation of roller cone 108 about bearing pin 200.

Figure 14:
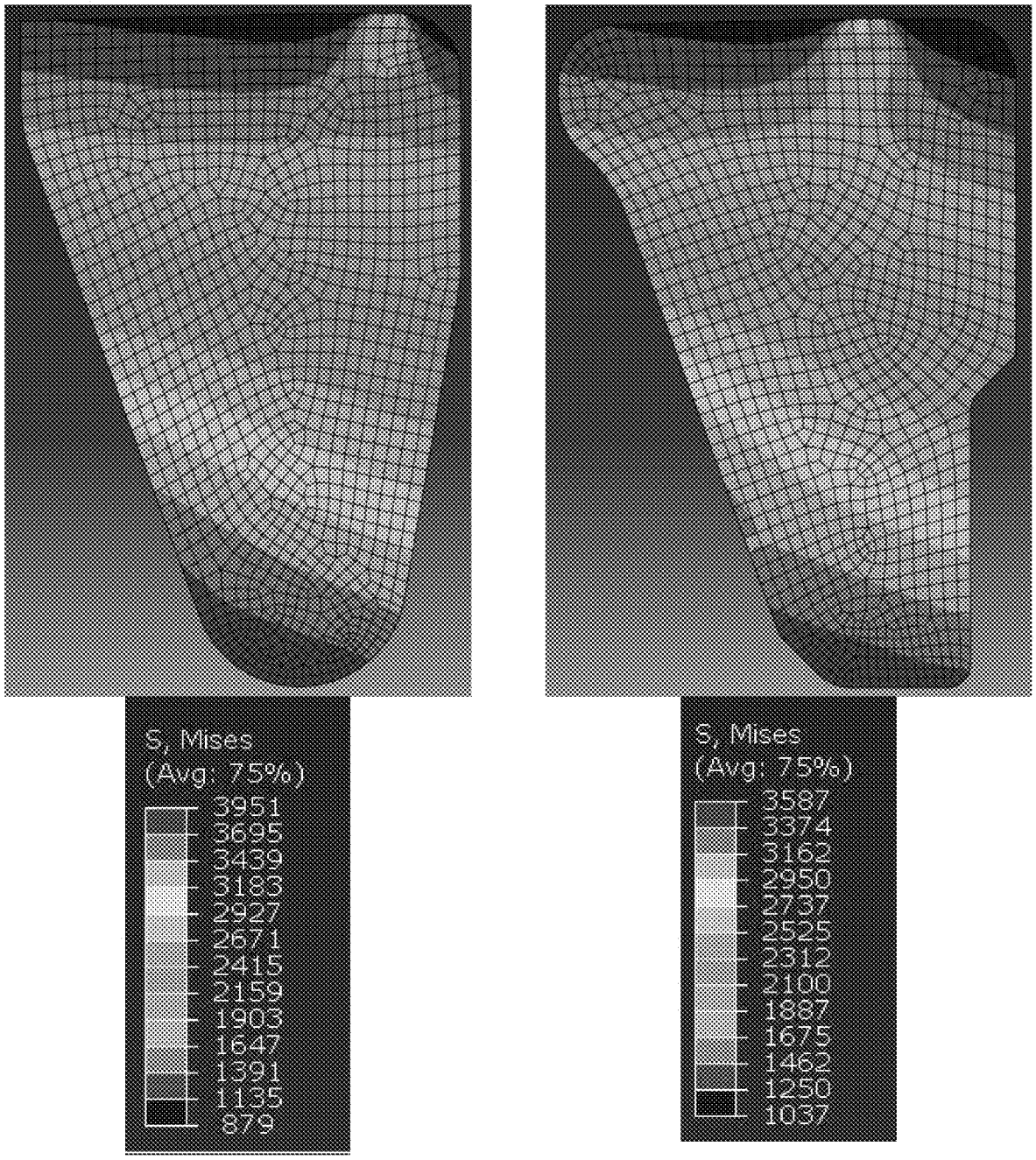
FIG. 14 is a diagram of the results of a finite element analysis (FEA) of the internal stresses of a seal ring disclosed herein, and a seal ring of a previous design.
Figure 15:
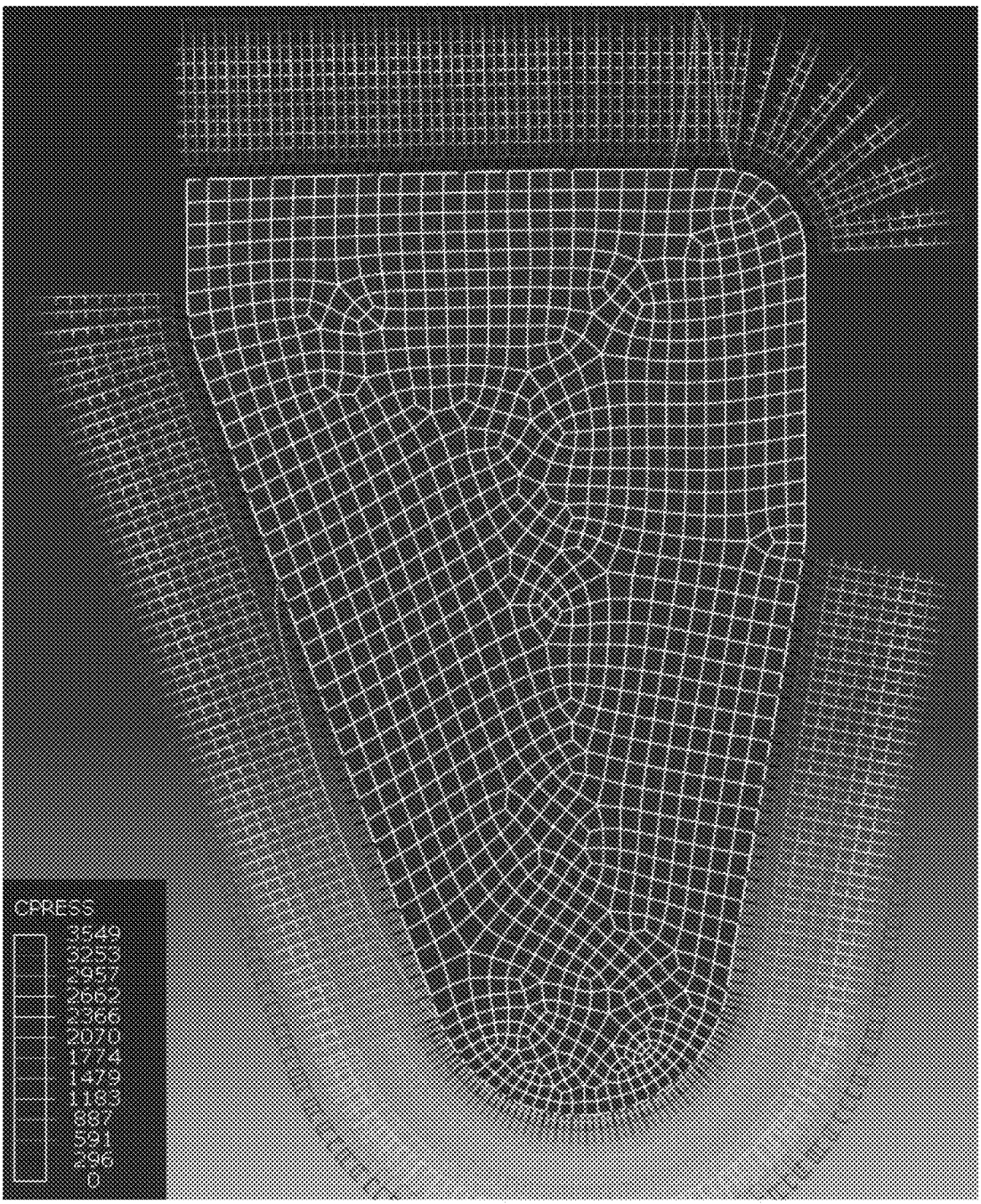
FIG. 15 is a diagram of the results of a FEA of the contact stresses of a seal ring disclosed herein.

As described above, seal ring 504 comprises a distal surface and proximal surface. The proximal surface 514 spans the radial thickness of seal ring 504, or, in other words, spans the distance between first sidewall 520 and second sidewall surface 522. In some embodiments, proximal surface 514 comprises a convex curved surface which tangentially intersects first and second sidewall surfaces 520 and 522. Put another way, the convex curved surface comprising proximal surface 514 intersects first and second sidewall surfaces 520 and 522, such that the angle between proximal surface 514 and each of the sidewall surfaces 520, 522 at the point of intersection is zero degrees. As such, proximal surface 514 may be said to be a full radius. The curvature of proximal surface 514 and smooth intersection with the sidewalls (i.e., the zero-degree intersection between proximal surface 514 and first and second sidewall surfaces 520 and 522) both serve to evenly disperse the contact forces exerted on proximal surface 514, reducing the potential for damage (e.g., tearing). FIG. 14 illustrates a finite element analysis (FEA) of the internal stresses of seal ring 504 (left) and a seal ring of a previous design (right). FIG. 15 illustrates a FEA of contact pressures of seal ring 504, and FIG. 16 illustrates a FEA of contact pressures a seal ring of a previous design.

In some embodiments, seal ring 504 comprises a metal material, such as a copper nickel tin alloy (e.g., TOUGH-MET®), or any other suitable metal material (i.e., metal alloy) known in the art. In some embodiments, surface 516 is also metal or a metal material. As such, the contact between seal ring 504 and surface 516 creates a metal face seal. The metal face seal (i.e., metal face seal 526) is a dynamic seal, meaning that seal ring 504 is configured to remain stationary with respect to bearing pin 200 as roller cone 108 rotates about bearing pin 200 during use. In other words, while roller cone 108 rotates about bearing pin 200, seal ring 504 does not rotate about bearing pin 200. Similarly, BUR 506, excluder 510, and energizer 508 also remain stationary with respect to bearing pin 200 as roller cone 108 rotates about bearing pin 200. In some embodiments, a diamond-like carbon (DLC) coating is deposited on distal surface 512, surface 516, or both. A DLC coating may be used to reduce friction and wear between the parts, to extend the service life of the rotary drill bit to attain additional drilled footage. A DLC coating may also reduce galling and corrosion.

FIG. 6 is an isolated cross-sectional view of seal ring 504. As described herein, proximal surface 514 may be said to be a full radius. In the disclosed embodiment, the radius R is approximately 24% of dimension X. Similarly, radius R may be approximately 16% of dimension Y. In other embodiments, radius R may be within the range of 15% to 40% of dimension X, and/or within the range of 10% to 25% of dimension Y. Testing has shown that a radius R outside of the aforementioned ranges (i.e., approximately 10% of dimension X, or less) results in a higher probability that the BUR will tear during use.

Figure 9:
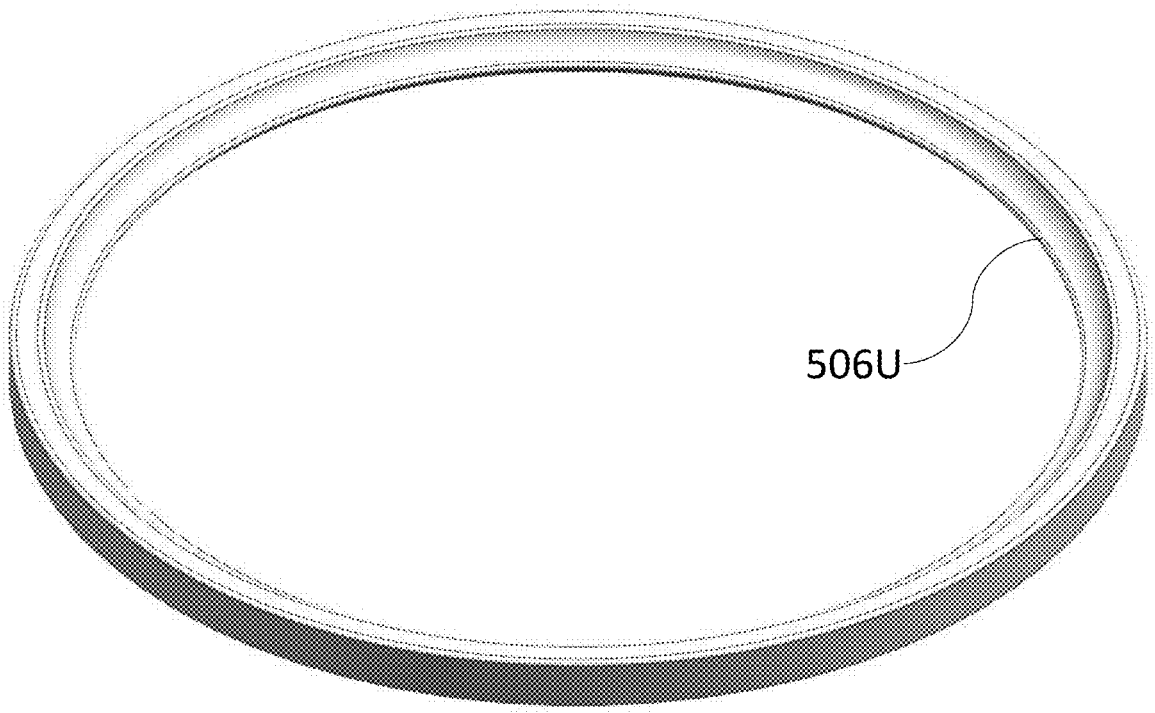
FIG. 9 is an isolated isometric view of the back-up ring of FIG. 7.
Figure 13:
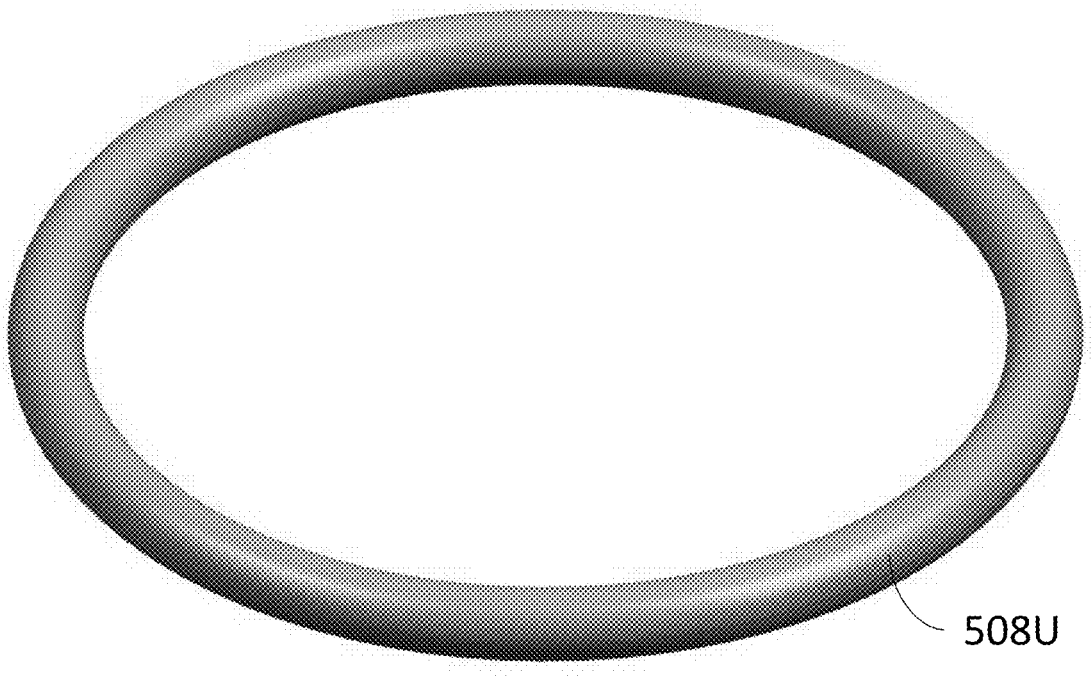
FIG. 13 is an isolated isometric view of the uncompressed energizer of FIG. 8.

Seal assembly 202 further comprises BUR 506 and energizer 508, as shown in FIG. 5. An isometric view of BUR 506U (i.e., BUR 506 in an uncompressed state) is shown in FIG. 9, and an isometric view of energizer 508U (i.e., energizer 508 in an uncompressed state) is shown in FIG. 13.

In conventional seal assemblies, a first polymer ring (e.g., an energizer ring) comprises a first material (e.g., HNBR) and a second polymer ring (e.g., a back-up ring) comprises a second different material (e.g., nitrile butadiene rubber (NBR)). As such, the second polymer ring has a lower shore A hardness (on the Rockwell hardness scale) than the first polymer ring. The low shore A hardness value of the second polymer ring increases the susceptibility of the second polymer ring to damage (e.g., tearing). Accordingly, the reliability of the rotary drill bit, as a whole, is reduced.

In the disclosed embodiment, in contrast to conventional seal assemblies, energizer 508 and BUR 506 each comprise an elastomer, and may have the same or different chemical compositions. For example, energizer 508 and BUR 506 are each comprised of, but not limited to, nitrile butadiene rubber (NBR), hydrogenated nitrile butadiene rubber (HNBR), perfluoroelastomer (FFKM), or fluoroelastomer (FKM). Additionally, in some embodiments, energizer 508 and BUR 506 have the same hardness on the Rockwell hardness scale. As a result, BUR 506 is less susceptible to damage (e.g., tearing). Energizer 508 and BUR 506 may have shore A hardness in the range of 40-90.

In one embodiment, a tensile strength (e.g., ultimate tensile strength) of BUR 506 is about 1550 pounds per square inch (PSI). Tensile strengths for energizer 508 and BUR 506 may be in a range of about 1400 psi to 3000 psi.

In the disclosed embodiment, one surface 530 of BUR 506 abuts a surface 532 of bearing pin 200 to form a seal between BUR 506 and bearing pin 200. Another surface of BUR 506, such as incurvated surface 524, is located and configured to interface with proximal surface 514 of seal ring 504, to form a seal with seal ring 504. As shown in FIG. 5, BUR 506 comprises a concave surface, such as incurvated surface 524, which has a curvature complementary to the convex curvature of proximal surface 514. When seal assembly 202 is in an assembled state, proximal surface 514 contacts incurvated surface 524 over an area of contact, and at least partially compresses BUR 506. The curvature of incurvated surface 524 serves to evenly disperse the contact forces incurvated surface 524 is subjected to, to reduce the potential for damage (e.g., tearing).

Figure 7:
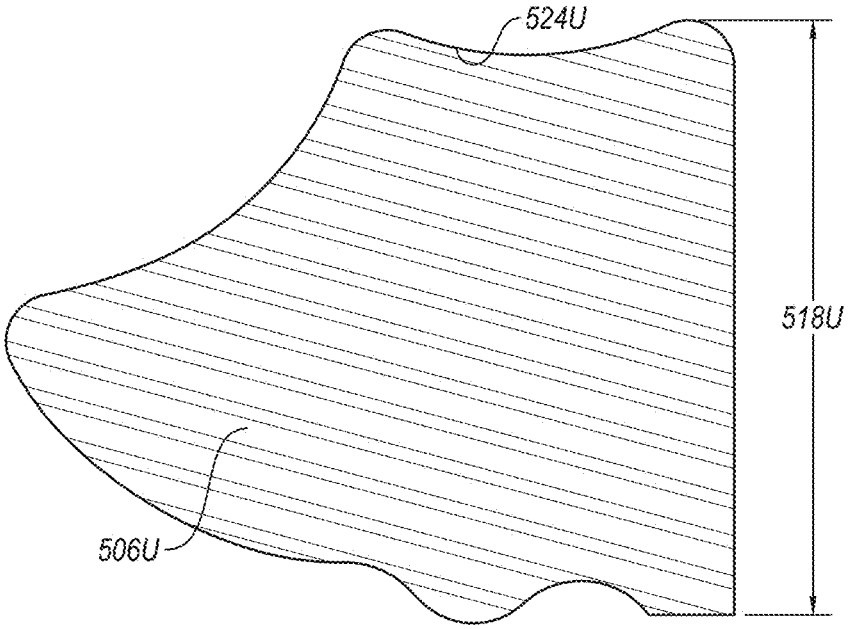
FIG. 7 is an isolated cross-sectional view of an uncompressed back-up ring of a seal assembly.

FIG. 7 shows an isolated cross-sectional view of BUR 506U (i.e., BUR 506 in an uncompressed state), and FIG. 9 shows an isometric view of BUR 506U. For clarity, when seal assembly 202 is in an unassembled state, BUR 506 is in an uncompressed state. As described above, incurvated surface 524/524U has a curvature complementary to the curvature of proximal surface 514. In the disclosed embodiment, the radius of curvature of incurvated surface 524/524U is approximately 120% to 140% of the radius R of proximal surface 514. In other embodiments, however, the radius of curvature of incurvated surface 524/524U is at least substantially the same as the curvature of proximal surface 514, or may be within the range of 100% to 150% of radius R of proximal surface 514.

Figure 8:
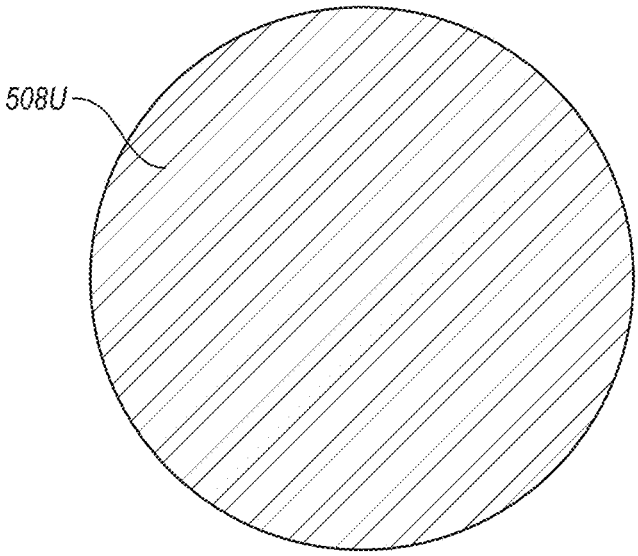
FIG. 8 is an isolated cross-sectional view of an uncompressed energizer of a seal assembly.

As described above, when roller cone 108 is mounted on the bearing pin 200 (i.e., when roller cone 108 is translated along axis 306 towards the base of the bearing pin 200), surface 516 applies a force on distal surface 512 of seal ring 504, which causes seal ring 504 to translate in the same direction as roller cone 108 along axis 306. The translation of seal ring 504 causes proximal surface 514 to be forced into incurvated surface 524, to at least partially compress BUR 506. In addition, the translation of seal ring 504 causes second sidewall surface 522 to be forced into energizer 508, to at least partially compress energizer 508. FIG. 8 depicts the cross-section of energizer 508U (i.e., energizer 508 in an uncompressed state), and FIG. 13 shows an isometric view of the uncompressed energizer 508U. For clarity, when seal assembly 202 is in an unassembled state, energizer 508 is uncompressed. When seal assembly 202 is in an assembled state, second sidewall surface 522 of seal ring 504 causes the energizer to be at least partially compressed.

The compression of BUR 506 and energizer 508 causes BUR 506 and energizer 508 to bias (or urge) distal surface 512 of seal ring 504 towards surface 516 to form metal face seal 526. More specifically, the biasing of BUR 506 and energizer 508 against seal ring 504 generates a force to establish metal face seal 526. The force resulting from energizer 508, F1, may be a first face load for metal face seal 526, and the force resulting from BUR 506, F2, may be a second face load for metal face seal 526. The total force on metal face seal 526 (i.e., total face load) is the sum of F1 and F2.

In conventional seal assemblies, a first polymer ring (e.g., an energizer ring) generates a force (or face load) on a metal face seal that is greater than the force (or face load) generated by a second polymer ring (e.g., a back-up ring). For example, the first polymer ring accounts for 80-60% of the total force (e.g., total face load) exerted on the metal face seal, while the second polymer ring accounts for 20-40% of the total force (e.g., total face load) exerted on the metal face seal. The lower force generated by the second polymer ring is based, in part, on the lower Rockwell hardness of the second polymer ring as compared to the higher Rockwell hardness of the first polymer ring.

In some embodiments disclosed herein, in contrast to conventional seal assemblies, force F2 (i.e., the force generated by BUR 506) is greater than force F1 (i.e., the force generated by energizer 508). For example, force F2 accounts for 50-70% of the total force (i.e., total face load) exerted on the metal face seal, while the force, F1 accounts for 30-50% of the total force exerted on the seal 50. In one embodiment, a range of a ratio between force F2 and force F1 is about 1 to 3.

Figure 10:
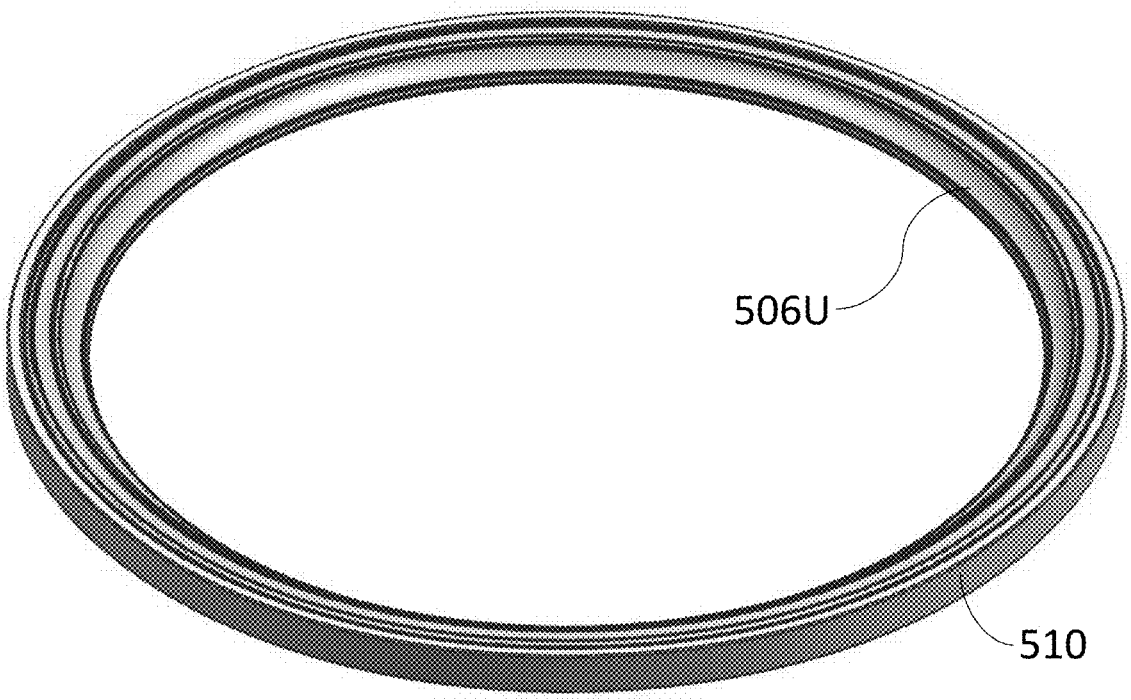
FIG. 10 is an isolated isometric view of an excluder surrounding the back-up ring of FIG. 9.

Seal assembly 202 further comprises excluder 510, as best seen in FIG. 5. Excluder 510 is positioned adjacent to, radially outward from, and concentric with, BUR 506. For clarity, FIG. 10 shows an isometric view of excluder 510 positioned adjacent to, radially outward from, and concentric with, BUR 506U (i.e., uncompressed BUR 506). With reference to FIG. 5, seal assembly 202 is adjacent gap 502, through which debris from the drilling environment may travel. Excluder 510 acts as a physical barrier to at least substantially block or prevent damaging contact between such debris and BUR 506. Excluder 510 may comprise a plastic, such as nylon, PEEK (polyetheretherketone), or DELRIN® (polyoxymethylene), or a lightweight metal, such as brass. It will be appreciated that excluder 510 may comprise any other suitable material known in the art. As described above, excluder 510 remains stationary with respect to bearing pin 200 when rotary drill bit 100 is in use. In other words, as roller cone 108 rotates about bearing pin 200, excluder 510 does not rotate about bearing pin 200, nor does excluder 510 rotate with respect to BUR 506.

In conventional seal assemblies (i.e., seal assemblies without an excluder ring), the back-up ring is free to expand towards, e.g., gap 502, when compressed. Further, back-up rings in conventional seal assemblies are likely to break or tear where the back-up ring expands and comes into contact with, e.g., bend 528 (FIG. 5). In the disclosed embodiment, excluder 510 prevents BUR 506 from expanding towards gap 502 when BUR 506 is compressed, to prevent contact between BUR 506 and bend 528 and stiffening BUR 506. It should be appreciated that excluder 510 has a higher Young's Modulus of elasticity than BUR 506, so that when BUR 506 expands, excluder 510 does not bend or yield.

As shown in FIG. 5, each of BUR 506 and excluder 510 have an axial height, such as axial height 518. In the disclosed embodiment, the axial height of excluder 510 (e.g., axial height 518) is at least substantially equal to the axial height of BUR 506 when BUR 506 is at least partially compressed (i.e. when seal assembly 202 is in an assembled state). In other embodiments, excluder 510 may have an axial height which is greater than the axial height of BUR 506 when BUR 506 is at least partially compressed, such as, for example, an axial height at least substantially equal to the axial height of BUR 506 in an uncompressed state (i.e., axial height 518U of BUR 506U). In other words, in other embodiments, the axial height of excluder 510 may be at least substantially equal to axial height 518U of BUR 506U. In still other embodiments, the axial height of excluder 510 may be less than the axial height of BUR 506. When the axial height of excluder 510 is at least substantially the same as the axial height of BUR 506, or when the axial height of excluder 510 is greater than the axial height of BUR 506, excluder 510 lessens or prevents damaging contact between BUR 506 and debris which have traveled from the drilling environment through gap 502.

Although the disclosed embodiment shows excluder 510 having a rounded rectangle cross-section, other embodiments may comprise excluder rings which have a different cross-sectional shape. For example, the excluder ring may have additional features to ensure proper spatial positioning, such as tabs which protrude into the BUR, or recesses configured to receive a protrusion of a BUR. In other embodiments, excluder 510 may be securely attached or bonded to BUR 506 via e.g., an adhesive or a heat process.

It should be appreciated that seal assembly 202, as depicted in FIG. 5, is in an assembled, non-use state. That is to say, rotary drill bit 100 is not in the act of boring/drilling. As such, the forces (i.e., the face load) at metal face seal 526 are generated only by BUR 506 and energizer 508, and do not include any other forces or loads from other sources, such as loads resulting from drilling. It should be understood that forces resulting from drilling may have a negligible effect on the forces at metal face seal 526, as the majority of the forces resulting from drilling are borne by ball bearings 312, or by surfaces of bearing pin 200 and roller cone 108, for example, surfaces 308 and 310, between which lubricant may be present. During drilling, the face load could be affected by hydrostatic pressure from the column of drilling fluid.

Also disclosed herein is a method of assembling a seal assembly (e.g., seal assembly 202) for an earth-boring rotary drill tool. As described herein, the seal assembly 202 is in an assembled state when the roller cone 108 is mounted on bearing pin 200. The assembled seal assembly 202 is best seen in FIG. 5.

To assemble seal assembly 202, first, second, and third rings (and in some embodiments, a fourth ring) are positioned prior to mounting a roller cone (e.g., roller cone 108) on a bearing pin (e.g., bearing pin 200) of a leg (e.g., leg 104) on a rotary drill bit (e.g., rotary drill bit 100). In particular, a first ring (e.g., BUR 506) is positioned adjacent the bearing pin such that a surface (e.g., surface 530) of the first ring contacts a surface (e.g., surface 532) of the pin. A second ring (e.g., seal ring 504) is positioned adjacent to the first ring. A third ring (e.g., excluder 510) is positioned adjacent to, and radially outward from, the first ring. In some embodiments, a fourth ring (e.g., energizer 508) is also positioned adjacent to, and slightly radially inward from, the first ring. The rings are all positioned in accordance with the above disclosure, and as shown in at least FIGS. 5 and 10. Once the rings are positioned, the roller cone is mounted on the bearing pin by translating the roller cone towards the base of the bearing pin (e.g., towards plane 316). The translation of the roller cone causes a surface (e.g., surface 516) of an insert ring (e.g., insert ring 326) to contact a first surface of the second ring (e.g., distal surface 512) to form a seal (e.g., metal face seal 526) between the second ring and the surface of the insert ring. In some embodiments, the insert ring may be omitted, and the first surface of the second ring forms a seal with a surface of the roller cone. The translation of the roller cone also causes the second ring to translate in the same direction, which results in a generally U-shaped second surface of the second ring (e.g., proximal surface 514) to come into contact with an incurvated surface (e.g., incurvated surface 524) of the first ring. The contact between the generally U-shaped second surface of the second ring and the incurvated surface of the first ring forms a seal between the first ring and the second ring. Once the roller cone has been mounted on the bearing pin, the seal assembly 202 is in an assembled state.

The embodiments of the disclosure described above and illustrated in the accompanying figures do not limit the scope of the invention, since these embodiments are merely examples of embodiments of the invention, which is defined by the appended claims and their legal equivalents. Any equivalent embodiments are intended to be within the scope of this disclosure. Indeed, various modifications of the present disclosure, in addition to those shown and described herein, such as alternative useful combinations of the elements described, may become apparent to those skilled in the art from the description. Such modifications and embodiments are also intended to fall within the scope of the appended claims and their legal equivalents.

What is claimed is:

1. A seal assembly for an earth-boring tool, the seal assembly comprising at least three rings, the at least three rings comprising a first ring, a second ring, and a third ring;

the first ring comprising longitudinally converging sidewall surfaces defining a minimum radial thickness of the first ring at points of tangential intersection with a convex curved surface spanning a radial thickness of the first ring;

wherein the second ring is located and configured to interface with the convex curved surface of the first ring to form a seal; and wherein the third ring is adjacent to, and concentric with, the second ring, the second ring being disposed radially inward from the third ring.

2. The seal assembly of claim 1, wherein the second ring comprises a concave surface located and configured to interface over an area of contact with the convex curved surface of the first ring to form the seal.

3. The seal assembly of claim 2, wherein a curvature of the convex curved surface of the first ring and a curvature of the concave surface of the second ring are at least substantially complementary.

4. The seal assembly of claim 1, wherein the second ring and the third ring each comprise an axial thickness, wherein the axial thickness of the third ring is at least substantially equal to the axial thickness of the second ring.

5. The seal assembly of claim 1, wherein the first ring comprises a metal material.

6. The seal assembly of claim 1, wherein the second ring comprises an elastomer.

7. The seal assembly of claim 6, wherein the elastomer comprises nitrile butadiene rubber (NBR).

8. The seal assembly of claim 1, wherein the third ring comprises a plastic material or a metal material.

9. The seal assembly of claim 1, wherein the convex curved surface comprises a radius of curvature within a range of 15% to 40% of a maximum radial thickness defined by the longitudinally converging sidewall surfaces.

10. An earth-boring rotary drill tool, comprising:

a bit body comprising at least one bearing pin;

at least one roller cone rotatably mounted over the at least one bearing pin; and at least one seal assembly disposed between the at least one bearing pin and the at least one roller cone, the at least one seal assembly comprising at least a first, second, and third ring;

the first ring comprising:

interior and exterior sidewall surfaces, wherein a distance between the interior and exterior sidewall surfaces defines a radial thickness of the first ring, a distal surface proximate a surface of the at least one roller cone to form a seal between the distal surface of the first ring and the surface of the at least one roller cone, and a proximal surface spanning the radial thickness of the first ring, wherein the proximal surface is generally U-shaped, and the interior and exterior sidewall surfaces tangentially intersect the proximal surface;

the second ring comprising an incurvated surface, located and configured to interface with the proximal curved surface of the first ring;

wherein the third ring is adjacent to, and concentric with, the second ring, the second ring being disposed radially inward the third ring; and wherein the first, second, and third rings remain stationary relative to the at least one bearing pin as the at least one roller cone rotates about the at least one bearing pin.

11. The earth-boring rotary drill tool of claim 10, wherein a curvature of the proximal surface of the first ring and a curvature of the incurvated surface of the second ring are substantially complementary.

12. The earth-boring rotary drill tool of claim 10, wherein the second ring and the third ring each comprise an axial thickness, wherein the axial thickness of the third ring is at least substantially equal to the axial thickness of the second ring.

13. The earth-boring rotary drill tool of claim 10, wherein the first ring comprises a metal material.

14. The earth-boring rotary drill tool of claim 10, wherein the second ring comprises an elastomer.

15. The earth-boring rotary drill tool of claim 14, wherein the elastomer comprises nitrile butadiene rubber (NBR).

16. The earth-boring rotary drill tool of claim 10, wherein the third ring comprises a plastic material or a metal material.

17. The earth-boring rotary drill tool of claim 10, wherein the proximal surface comprises a radius of curvature within a range of 15% to 40% of a maximum radial thickness of the first ring.

18. The earth-boring rotary drill tool of claim 10, wherein the third ring is bonded to the second ring.

19. The earth-boring rotary drill tool of claim 10, wherein the second ring is configured to be at least partially compressed by the first ring, wherein the second ring, when at least partially compressed by the first ring, biases the distal surface of the first ring against the surface of the at least one roller cone.

20. A method of assembling a seal assembly for an earth-boring rotary drill tool, the method comprising:

positioning a first ring adjacent a base of a bearing pin carried by a body of an earth-boring rotary drill bit, wherein a first surface of the first ring contacts an area of a surface of the bearing pin;

positioning a second ring adjacent the base of the pin and adjacent the first ring;

positioning a third ring adjacent to, and radially outward from, the first ring, wherein the third ring is concentric with the first ring; and translating a roller cone towards the base of the bearing pin along an axis of the pin to mount the roller cone on the bearing pin, wherein a first surface of the second ring contacts an area of a surface of the roller cone, and wherein translating the roller cone biases a generally U-shaped second surface of the second ring onto a concave second surface of the first ring, wherein a curvature of the concave second surface of the first ring is complementary to a curvature of the generally U-shaped second surface of the second ring.

* * * * *